United States Patent [19]

Gunter

[11] Patent Number: 4,720,975

[45] Date of Patent: Jan. 26, 1988

[54] CONTROL VALVE

[75] Inventor: William C. Gunter, Tulsa, Okla.

[73] Assignee: Ramsey Winch Company, Tulsa, Okla.

[21] Appl. No.: 863,775

[22] Filed: May 15, 1986

[51] Int. Cl.[4] ..... F15B 15/00

[52] U.S. Cl. ..... 60/442; 60/466; 91/447

[58] Field of Search ..... 60/435, 442, 466; 91/447, 468; 137/106

[56] References Cited

U.S. PATENT DOCUMENTS

| | | | |
|---|---|---|---|
| 3,640,009 | 2/1972 | Sugabara | 91/447 X |
| 3,643,922 | 2/1972 | Van Der Linde . | |
| 4,244,275 | 1/1981 | Smilges . | |
| 4,278,010 | 7/1981 | Wallischeck et al. . | |
| 4,323,222 | 4/1982 | Dempster et al. . | |
| 4,324,387 | 4/1982 | Steinhagen . | |
| 4,342,256 | 8/1982 | Andersen et al. . | |
| 4,615,174 | 10/1986 | Nagabara | 60/442 |

*Primary Examiner*—Alan Cohan

*Attorney, Agent, or Firm*—Richards, Harris, Medlock & Andrews

[57] ABSTRACT

A control valve (10) is disclosed for use in controlling a winch motor (12) on a winch. The control valve (10) is employed with a conventional operating valve (32). When the operating valve is in the neutral position, the control valve (10) acts as a hydraulic brake and an unloading valve for a brake cylinder (20). When the operating valve (32) is moved to raise a load with the winch, the control valve provides a flow path to and from the winch motor (12) to rotate the motor to raise the load and provides sufficient hydraulic pressure in the brake cylinder chamber (18) to release the brake even if the winch has no load. When the operating valve is operated to lower the load, the control valve (10) acts as an over center valve to prevent the load and winch from running away from the winch motor (12). The control valve (10) accomplishes each of these functions with only a single valve spool (132) slidable in a valve housing (100).

6 Claims, 4 Drawing Figures

RAISE

LOWER

CONTROL VALVE

TECHNICAL FIELD

This invention relates to a control valve of the spool type, particularly adapted for controlling the operation of a winch motor.

BACKGROUND ART

Hydraulic winches and hoists are frequently used to raise and lower a load. For the sake of expediency, these devices will collectively be referred to as winches hereinafter.

The typical hydraulic winch is driven by a reversible hydraulic motor. The motor is rotated in one direction to raise the load by providing pressurized fluid to a first port in the motor while permitting the other port to drain. Conversely, the motor can be operated in the reverse direction by providing pressurized fluid to the second port, and draining the first port.

A number of features have become standard on hydraulic winches. A hydraulic brake is commonly employed which blocks fluid flow from the side of the winch motor which would permit the load to be lowered. The weight of the load simply pressurizes the fluid in the port to prevent the winch motor from rotating to thus act as a hydraulic brake.

Another common feature in hydraulic winch controls is a hydraulic circuit for operating a mechanical brake on the winch. The mechanical brake is constantly urged into the braking position. This action is usually accomplished by mechanical compression springs. A hydraulic cylinder is provided to release the brake during winch movement by providing pressurized hydraulic fluid to act in the cylinder to release the brake. Thus, failure of the hydraulic control circuit causes the brake to be applied.

As can be readily understood, when a load is to be lowered by a winch, some provision must be made to prevent the winch from running away from the operator and lowering the load in an uncontrolled manner. In the past, over center or counterbalance valves have been employed to control lowering. One example of a counterbalance valve is disclosed in U.S. Pat. No. 4,244,275 to Smilges, issued Jan. 13, 1981. The over center valve controls the rate of hydraulic fluid flow from the port of the motor permitting lowering of the load in response to the maintenance of pressurized fluid in the other port of the motor to prevent the winch from running away.

While hydraulic control systems have been available for controlling hydraulic winches to perform the various desired functions noted previously, a need still exists to refine the control systems to minimize the complexity and physical size of the control system, maximize efficiency and reliability of the control system and minimize both the initial cost and maintenance costs of the system.

SUMMARY OF THE INVENTION

In accordance with one aspect of the present invention, a control valve is provided for controlling a reversible winch motor. The winch motor has first and second ports, entry of a pressurized fluid in the first port while permitting fluid to drain from the second port rotating the winch motor in a first direction to raise a load. Entry of a pressurized fluid in the second port while permitting the first port to drain rotates the winch motor to lower the load. The winch motor is operated by a three position operating valve. The neutral position of the operating valve drains both a raise and lower line. The raise position of the operating valve provides pressurized fluid to the raise line while draining the lower line. The lower position of the operating valve provides pressurized fluid to the lower line and drains the raise line.

The control valve includes a valve body defining a cylindrical valve chamber centered on a first axis. The cylindrical valve chamber opens into a first spring chamber at a first end thereof and into a second spring chamber at a second end thereof. A valve spool is slidable along the cylindrical valve chamber of the valve body. The raise and lower lines and the first and second ports of the winch motor are each hydraulically connected through the wall of the cylindrical valve chamber at various positions along the length of the chamber. First spring structure is provided to progressively resist movement of the spool into the first spring chamber while second spring structure is provided to progressively resist movement of the spool into the second spring chamber.

Structure is provided on the spool to hydraulically isolate the first port of the winch motor from the drain so that the control valve acts as a hydraulic brake when the operating valve is in the neutral position. Structure is also provided on the spool so that when the operating valve is moved to the lower position, the control valve acts as an over center valve by restricting flow from the first port of the winch motor to the drain as the spool is moved into the first spring chamber for a distance determined by the pressure in the lower line. Structure is also provided for hydraulically connecting the raise line and first port and draining the second port to raise the load when the operating valve is in the raise position by moving the spool into the second spring chamber against the force exerted by the second spring structure with the pressurized fluid in the raise line.

In accordance with another aspect of the present invention, a brake is provided. A hydraulic cylinder having a chamber releases the brake upon entry of pressurized hydraulic fluid into the chamber. The brake is applied by draining pressurized hydraulic fluid from the chamber. The control valve further has structure for draining the chamber of the brake cylinder when the operating valve is in the neutral position and for providing pressurized fluid to release the brake when the operating valve is in either the raise or lower position.

BRIEF DESCRIPTION OF THE DRAWINGS

A more complete understanding of the invention can be had by referring to the following detailed description together with the accompanying drawings, wherein.

DETAILED DESCRIPTION

Figure 1:
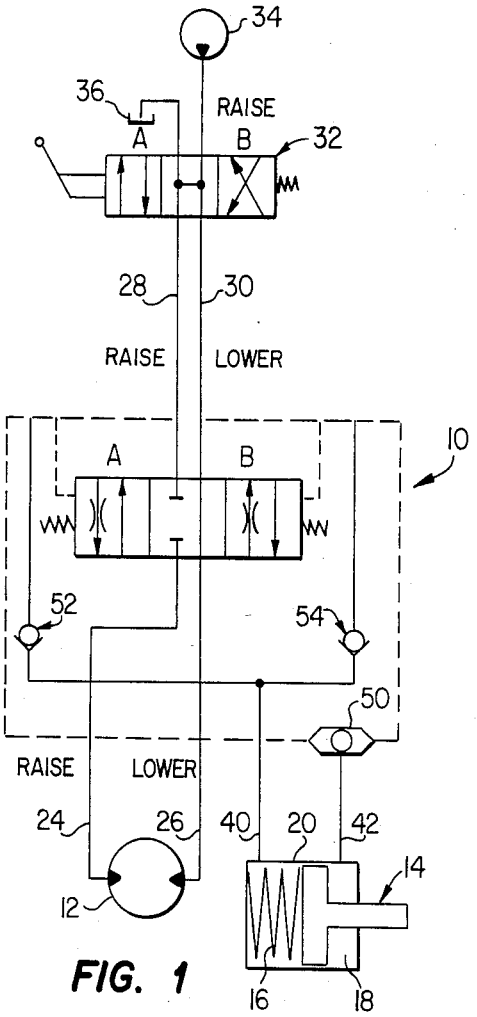
FIG. 1 is a hydraulic control schematic of a control valve forming a first embodiment of the present invention and the other elements in a hydraulic winch.

With reference now to the drawings, wherein like reference numerals designate like or corresponding parts throughout the several views, there is shown a control valve 10 forming one embodiment of the present invention.

The control valve 10 is employed with a conventional hydraulic winch operated by a hydraulic winch motor 12 to raise and lower a load. A mechanical brake 14 is provided which is applied by a mechanical spring 16 to hold the winch and winch motor in a set position. The mechanical brake 14 can be released only by providing pressurized fluid to chamber 18 of a brake cylinder 20 to act against the force of the mechanical spring 16 to release the brake.

The raise port 24 of the winch motor 12 is connected to the control valve 10. The lower port 26 of the winch motor 12 is also connected to the control valve 10. By providing pressurized fluid to raise port 24 while permitting fluid to drain from lower port 26, the winch motor 12 is rotated in a direction to lift a load with the winch. The winch motor 12 can be operated in the opposite direction by providing pressurized fluid to lower port 26 and draining fluid from raise port 24. However, if either port is prevented from draining, the presence of pressurized fluid in the other port will simply cause the motor to lock up in a predetermined position as the fluid blocked from draining will simply be pressurized to the equivalent pressure of the other port.

A raise line 28 and a lower line 30 are interconnected between the control valve 10 and an operating valve 32. The operating valve 32 selectively controls the connection of lines 28 and 30 to pressurized hydraulic fluid from a pump 34 and a reservoir or drain 36.

In the neutral position of operating valve 32, as seen in FIG. 1, the pressurized hydraulic fluid from the pump 34 is simply routed to the drain 36 and both raise and lower lines 28 and 30 are also drained. When the operating valve 32 is moved to position B, the winch motor 12 is rotated to raise the load as pressurized hydraulic fluid is provided to the raise line 28 and lower line 30 is connected to drain. In contrast, when operating valve 32 is moved to position A, the winch is lowered as pressurized fluid is provided to lower line 30 and raise line 28 is connected to drain.

With reference to FIG. 1, the general hydraulic function of control valve 10 will be explained. When the operating valve 32 is in the neutral position, no pressurized fluid is provided in lines 28 or 30. Thus, the control valve 10 is in the neutral position as shown in FIG. 1. In the neutral position, the raise port 24 of the winch motor 12 is hydraulically isolated from raise line 28. The control valve 10 thus serves as a line check or hydraulic brake when a load is supported by the winch and winch motor 12 to assist the mechanical brake 14 in holding the load. Also, the control valve 10 acts as an unloading valve in the neutral position by balancing the pressure acting on opposite sides of the piston in the brake cylinder 20 to permit the brake to be applied. This function is represented by the shuttle valve symbol 50 draining to both lines 28 and 30.

When the winch is to be raised, the operating valve 32 is moved to position B to provide pressurized hydraulic fluid to raise line 28 and drain lower line 30. The pressure in raise line 28 is used to control the valve 10 to move to position A to provide the pressurized fluid to the raise port 24 of the winch motor 12 and drain the lower port 26 to rotate the winch motor 12 to raise the load. Simultaneous with the rotation of the winch motor 12, pressurized fluid from line 28 will flow into chamber 18 to release the brake. In position A, sufficient restriction to flow is provided so that the pressure in chamber 18 will be sufficient to release the brake even though no load is being lifted as the winch is rotated in the raise direction. The line 40, which can represent a drain from a shaft seal or other element where pressurized fluid could harm the operation of the element is drained through the control valve 10 to the lower line 30 through whichever one of the lines 28 and 30 that is not pressurized, as represented by check valve symbols 52 and 54.

When the winch and load are to be lowered, the control valve 10 operates as an over center valve to prevent the load from running ahead of the winch motor 12. To lower the winch and load, the operating valve 32 is moved to position A. Pressurized hydraulic fluid is then provided through line 30 and line 28 is drained. Pressurized fluid from line 30 is used to control the valve 10 to move the valve to position B. The control valve 10 provides a restriction to flow from raise port 24 to line 28 as represented in FIG. 1 to provide the over center valve function. The pressurized fluid from line 30 also acts in chamber 18 to release the brake 14 to permit lowering. Control valve 10 continues to provide a drain for line 40 through line 28.

The specific structure of control valve 10 will now be described with reference to FIGS. 2, 3 and 4. The control valve 10 includes a valve body 100 which is preferably part of the winch motor housing, but can be mounted separately therefrom if desired. The valve housing defines a cylindrical valve chamber 102 centered on a first axis 104. The cylindrical surface of the chamber 102 is generally a smooth sealing surface, interrupted by a series of annular recesses formed into the housing 100 at precisely spaced positions along the length of the chamber 102 and are connected with the various ports 24 and 26, and lines 28 and 30. For aid in understanding the invention, each of the recesses will be numbered with the same reference numeral as the line or port to which it is hydraulically connected.

Figure 2:
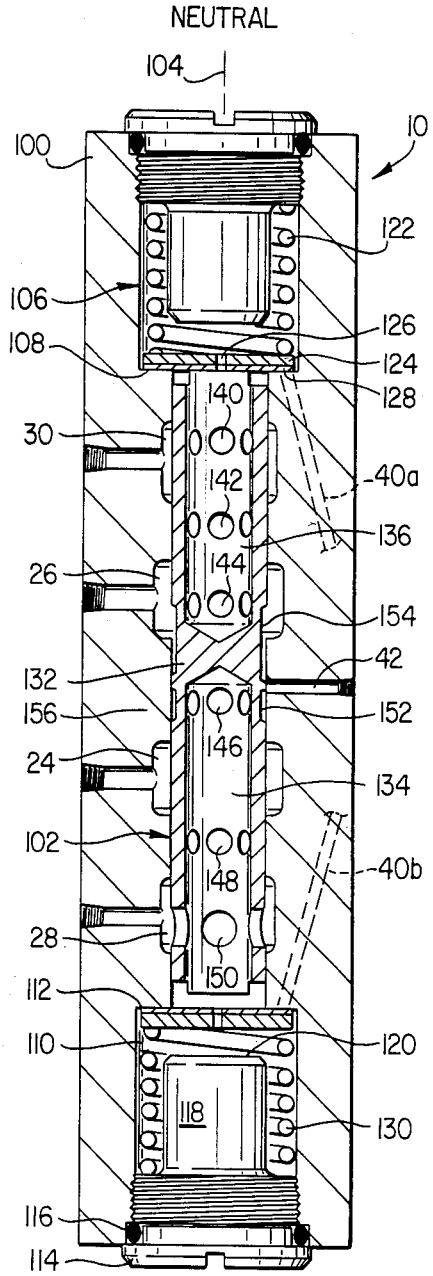
FIG. 2 is a cross sectional view of the control valve illustrating the spool in the neutral position.
Figure 3:
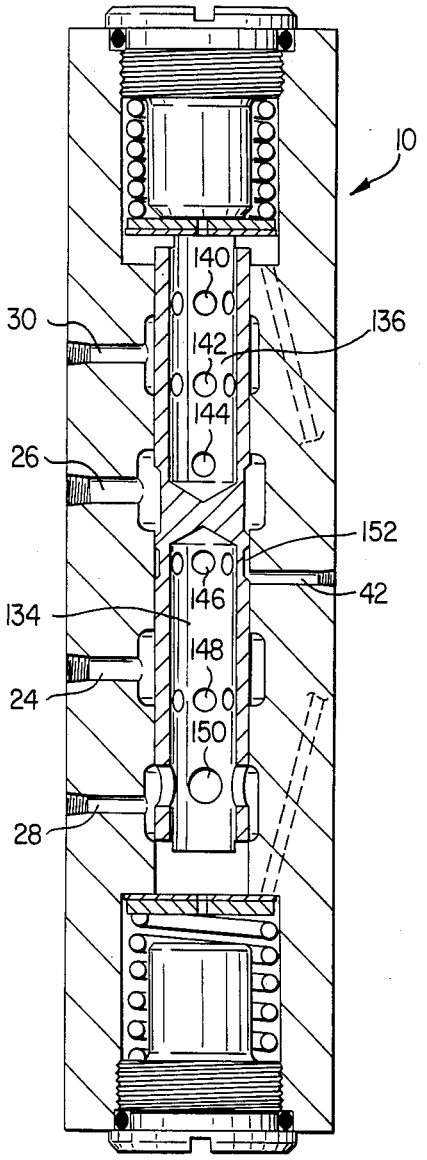
FIG. 3 is a cross sectional view of the control valve illustrating the spool in the position to raise the load.
Figure 4:
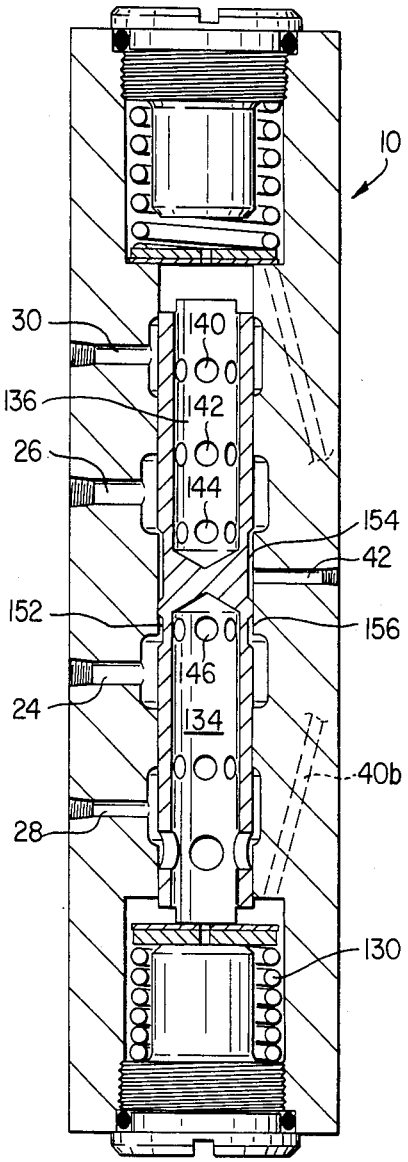
FIG. 4 is a cross sectional view of the control valve illustrating the spool in the position to lower the load and acting as an over center valve.

At one end of the chamber 102, the top end as shown in FIGS. 2–4, the chamber 102 opens into a raise spring chamber 106. The diameter of chamber 106 is greater than that of chamber 102 to define an annular ledge 108. The opposite end of chamber 102, the lower end as seen in FIGS. 2–4, opens into a lower spring chamber 110 also having a larger diameter than the chamber 102 to define an annular ledge 112. Each of the spring chambers is closed off by a sealing plug 114 threadedly secured into the respective chambers and sealed through an O ring 116. Each sealing plug has an extension 118 which ends with a stop surface 120.

Each of the spring chambers contains a spring. In raise chamber 106, a raise spring 122 is supported at one end by the plug 114, extends along the extension 118 of the plug and acts at its other end against an orifice washer 124 having a center positioned orifice 126. A gasket washer 128 of similar diameter to orifice washer 124 is positioned on the side of washer 124 opposite the spring 122 and is positioned between washer 124 and the annular ledge 108. The gasket washer 128 has a hole aligned with the orifice 126 in washer 124. A lower spring 130 is similarly positioned within lower spring chamber 110 between similar elements.

A valve spool 132 is slidably positioned within the valve housing 100. Spool 132 is just slightly shorter than the length of chamber 102. The valve spool 132 has a generally uniform outer diameter which is precisely sized relative to the inner surface of the cylindrical valve chamber 102 to permit sliding movement of the spool 132 along the chamber 102 but prevent significant hydraulic fluid leakage between facing areas of the inner surface of the chamber 102 and the outer surface of valve spool 132. The valve spool has a raise compartment 134 formed into the interior of the spool from the end facing the lower spring chamber 110 and a lower compartment 136 formed into the interior of the spool 132 from the end facing the raise spring chamber 106. The two compartments are isolated from each other.

Various sets of ports 140–150 are formed through the wall of the spool 132 between a particular compartment and open through the outer cylindrical surface of the spool. Each of the port sets has a precisely controlled diameter and a precisely controlled location along the length of the spool parallel the first axis. An annular notch 152 is formed through the outer cylindrical surface of the spool inward to connect with the port set 146. A similar, although longer, annular notch 154 is formed into the outer cylindrical surface of the spool and connects with the port set 144.

The line 40 to be drained is branched into two lines **40*a* and 40*b* within valve 10. Each lines opens into a spring chamber through the surfaces 108 and 112**, respectively.

The control line from brake chamber 18 enters the valve body and opens into the chamber 102 as shown.

In operation, when the operating valve 32 is in the neutral position, lines 28 and 30 are drained. The control valve 10 acts as a line check or hydraulic brake against undesired lowering of the winch by preventing flow of hydraulic fluid from port 24 to any other location within the control valve 10 or outside the control valve 10. Spool 132 can be removed from the housing by undoing a plug 114 and repositioned the spool in the housing the reversed way to create a hydraulic brake action in the reverse direction of rotation of the winch motor. Raise port 26 is connected to drain through ports 144, lower compartment 136, ports 140 and finally to line 30. The control valve 10 serves as an unloading valve for the chamber 18 in the brake cylinder 20 by connecting brake line 42 through either annular notch 152 to ports 146, through raise compartment 134, through ports 150 and to line 28 or through annular notch 154 to ports 144, through lower compartment 136, ports 140 and to line 30, depending on the spool position because the spool is slightly shorter than chamber 102 and either notch 152 as notch 154 will be aligned with port 42 in the neutral position. If any pressure has built up in line 40, the gasket washers 128 are lifted away from the surfaces 108 and 112 to relieve the pressure into compartments 134 and 136, satisfying the functions of check valves 52 and 54.

When the load is to be lowered by rotating the winch in the lowering direction, the control valve 10 acts as an over center valve to prevent the load from running away from the motor as seen in FIG. 4. To lower the load, the operating valve 32 is moved to position A to provide pressurized hydraulic fluid to line 30.

Reference is now had to FIGS. 2 and 4. The pressurized fluid from line 30 will enter the lower compartment 136 through ports 140. The fluid will pass through the compartment through ports 144 to the lower port 26 of the winch motor 12. However, in addition, the presence of the pressurized fluid in compartment 136 urges the spool in a direction so that the spool enters the lower spring chamber 110 as seen in FIG. 4. As the pressure in lower compartment 136 increases, the spool moves further into the lower spring chamber 110 against the progressively increasing resistance of the lower spring 130. Movement of the spool is limited by the contact between the spool and the stop surface 120 of the plug 114 in the lower chamber 110 through the respective washers 124 and 128 therebetween.

While pressurized fluid is provided through line 30, the winch and winch motor 12 cannot be lowered unless fluid is drained from the raise port 24 to prevent the winch motor 12 from locking. The size and position of ports 146 and the dimensions of annular notch 152 are precisely controlled so that they perform a metering function with land 156 so that flow is permitted from port 24 through notch 152 and ports 146 to drain only when a substantial pressure exists in the lower compartment 136. If the load and winch were to begin to run away from the winch motor 12, the pressure in line 30 and compartment 136 would drop, which would eliminate the force acting against the compression of the lower spring 130 and cause the spool to move from the position shown in FIG. 4 to the position shown in FIG. 2, preventing flow from port 24 to stop motion of the winch. By proper selection of orifice and notch dimensions and spring forces, the control valve 10 can be used to provide the optimum choking effect between land 156 and notch 152 and ports 146 to achieve the desired operating characteristics.

With the pressure in compartment 136 maintained at an elevated level, the pressure is communicated through annular notch 154 to line 42 to maintain the brake in the released position. Any pressure in line 40 is exhausted through line **40*b* to compartment 134, past washer 128. Pressurized fluid in compartment 136 passes through the hole in the washer 128 and orifice 126 into chamber 106 to equalize the pressure between chamber 106 and compartment 136. The pressure urges the washer 128 into sealing engagement around the opening of port 40*a* when pressure is relieved from compartment 136, the chamber pressure in chamber 106 will be relieved to compartment 136**.

When the load is to be raised, the operating valve 32 is moved to position B to pressurize the fluid in line 28 and drain line 30. The pressurized fluid enters raise compartment 134 through ports 150 to urge the end of the spool into the raise spring chamber 106 to compress the raise spring 122 as seen in FIG. 3 (corresponding to position A in FIG. 3). Pressurized fluid will be provided to the raise port 24 only when the spool is moved sufficiently so that ports 148 can communicate with port 24. The port 148 serves the function of a variable orifice during raising to provide sufficient pressure through ports 146, notch 152 and brake line 42 to maintain the brake in the released position even when no load is present on the winch during the raising operation. The fluid drained from port 26 will pass through ports 144, compartment 136, ports 140 and to the drain line 30. Again, the movement of the spool into the raise spring chamber 106 will be limited by contact between the end of the spool and the end of the sealing plug 114 with the washers 124 and 128 therebetween. Fluid pressure in line **40*a* can drain past washer 128 in chamber 106** as shown.

While only one embodiment of the present invention has been illustrated in the accompanying drawings and described in the foregoing detailed description, it will be understood that the invention is not limited to the embodiment disclosed, but is capable of numerous rearrangements, modifications and substitutions of parts and elements without departing from the spirit of the invention.

I claim:

1. A control valve for controlling a reversible winch motor and winch brake, the winch motor having first and second ports, entry of a pressurized fluid in the first port while permitting fluid to drain from the second port rotating the winch motor in a first direction to raise a load, entry of a pressurized fluid in the second port while permitting fluid to drain from the first port rotating the winch motor in the opposite direction to lower a load, the winch motor being operated by a three position operating valve, the neutral position of the operating valve draining raise and lower lines, the raise position of the operating valve providing pressurized fluid to the raise line and draining the lower line, the lower position of the operating valve providing pressurized fluid to the lower line and draining the raise line; and the winch brake being releasable by entry of pressurized fluid into a brake release chamber communicating hydraulically with the control valve, the control valve comprising:

a valve body defining a cylindrical valve chamber centered on a first axis, the cylindrical valve chamber opening into a first spring chamber at a first end of the valve chamber and opening into a second spring chamber at the opposite end of the valve chamber;

a cylindrical valve spool slidable along the cylindrical valve chamber;

first spring means for progressively resisting movement of the valve spool into the first spring chamber;

second spring means for progressively resisting movement of the valve spool into the second spring chamber;

the raise and lower lines and first and second ports each individually being hydraulically connected with a recess formed into the valve body through the surface of the cylindrical valve chamber, the recesses being spaced along the length of the cylindrical valve chamber along the first axis;

said valve spool having means for preventing fluid drain from the first port of the winch motor when the operating valve is in the neutral position so that the control valve acts as a hydraulic brake;

the valve spool having means to urge the spool valve into the first spring chamber in response to the presence of pressurized fluid in the lower line when the operating valve is in the lower position and metering flow from the first port to the raise line to drain as a function of the pressure in the lower line to act as an over center valve;

said control valve further having means for connecting the brake release chamber to pressurized fluid when the operating valve is positioned in the raise and lower positions.

2. The control valve of claim 1 further for use in controlling a winch brake which is released by entering pressurized fluid into a chamber to release the brake, the chamber being hydraulically connected through the surfaceof the cylindrical valve chamber, said control valve further having means for connecting the brake chamber to pressurized fluid when the operating valve is positioned in the raise and lower positions.

3. The control valve of claim 1 wherein elements of the winch motor must be continuously drained, said control valve having means for selectively draining said elements through one of said spring chambers.

4. A control valve for controlling a reversible winch motor and winch brake, the winch motor having raise and lower ports, entry of a pressurized fluid in the raise port while permitting fluid to drain from the lower port rotating the winch motor in a first direction to raise a load, entry of a pressurized fluid in the lower port while permitting fluid to drain from the raise port rotating the winch motor in the opposite direction to lower a load, the winch motor being operated by a three position operating valve, the neutral position of the operating valve draining raise and lower lines, the raise position of the operating valve providing pressurized fluid to the raise line and draining the lower line, the lower position of the operating valve pressurizing the lower line and draining the raise line; the winch brake being releasable by pressurizing fluid in a chamber in a brake cylinder, from the control valve comprising:

a valve body defining a cylindrical valve chamber centered on a first axis, the valve body defining four recesses therein opening through the surface of the cylindrical valve chamber at selected positions along the length of the cylindrical valve chamber, the first recess most closely adjacent a first end of the cylindrial valve chamber being in hydraulic communication with the lower line, the second recess along the length of the cylindrical valve chamber being in fluid communication with the lower port, the third recess along the length of the cylindrical valve chamber from the first end being in hydraulic communication with the raise port and the fourth recess being in hydraulic communication with the raise line;

the valve body defining a first spring chamber, the first end of the cylindrical valve chamber opening therein;

said valve body defining a second spring chamber, the opposite end of the cylindrical valve chamber opening therein;

a valve spool slidably received in the cylindrical valve chamber, the valve spool having a first and second compartment formed from opposite ends thereof into the interior of the spool, said compartments being isolated from each other, the first compoartment facing the first spring chamber and the second compartment facing the second spring chamber, first, second and third sets of ports being formed through the spool from the first compartment and opening through the outer cylindricfal surface of the spool and fourth, fifth and sixth sets of ports through the valve spool from the second compartment opening through the outer cylindrical surface of the spool;

a first spring positioned in the first spring chamber for progressively resisting movement of the spool into the first spring chamber;

a second spring positioned in the second spring chamber for progressively resisting movement of the spool into the second chamber;

the spool blocking floow from the raise port when the operating valve is in the neutral position to perform a hydraulic braking function, movement of the operating valve into the raise position causing pressurized fluid to enter the second compartment through the sixth set of ports to move the spool into the first spring chamber against the resistance of the first spring, flow passing through the fifth set of ports from the second compartment to the raise port to raise the load, the drain from the lower port passing through the lower port, through the third port set into the first compartment and then through the second port set to the lower line for draining, movement of the operating valve to the lower position providing pressurized hydraulic fluid through the lower line through the first set of ports into the first compartment and thence from the first compartment through the third port set to the lower port, fluid being drained from the raise port through a fourth set of ports into the second compartment and thence from the second compartment through the sixth set of ports to the raise line for drain, flow from the raise port through the fourth set of ports being choked by the spool when the pressure in the first compartment is lowered, causing the first spring to move the spool toward the neutral position to prevent the load from running away from the winch motor;

said control valve further including a port formed through the valve body and opening through the surface of the cylindrical valve chamber between the second and third recesses and in communication with the chamber in the brake cylinder; and first and second annular grooves formed in the outer surface of the spool at spaced locations along the length of the spool, each of said grooves in fluid communication with a compartment, the presence of pressurized fluid in one of the compartments moving the spool to a position to provide pressurized fluid from that compartment through the associated groove to release the brake.

5. The control valve of claim 4 further for use for controlling a winch brake, the winch brake being released by pressurizing fluid in a chamber in a brake cylinder, said control valve further including a port formed through the valve body and opening through the surface of the cylindrical valve chamber between the second and third recesses and in communication with the chamber in the brake cylinder; and first and second annular grooves formed in the outer surface of the spool at spaced locations along the length of the spool, each of said grooves in fluid communication with a compartment, the presence of pressurized fluid in one of the compartments moving the spool to a position to provide pressurized fluid from that compartment through the associated groove to release the brake.

6. A control valve for controlling a reversible winch motor and winch brake, the winch motor having first and second ports, entry of a pressurized fluid in the first port while permitting fluid to drain from the second port rotating the winch motor in a first direction to raise a load, entry of a pressurized fluid in the second port while permitting fluid to drain from the first port rotating the winch motor in the opposite direction to lower a load, the winch motor being operated by a three position operating valve, the neutral position of the operating valve draining raise and lower lines, the raise position of the operating valve providing pressurized fluid to the raise line and draining the lower line, the lower position of the operating valve providing pressurized fluid to the lower line and draining the raise line; and the winch brake being releasable by entry of pressurized fluid into a brake release chamber communicating hydraulically with the control valve, the control valve comprising:

a valve body defining a cylindrical valve chamber centered on a first axis, the cylindrical valve chamber opening into a first spring chamber at a first end of the valve chamber and opening into a second spring chamber at the opposite end of the valve chamber;

a cylindrical valve spool slidable along the cylindrical valve chamber;

first spring means for progressively resisting movement of the valve spool into the first spring chamber;

second spring means for progressively resisting movement of the valve spool into the second spring chamber;

the raise and lower lines and first and second ports each individually being hydraulically connected with a recess formed into the valve body through the surface of the cylindrical valve chamber, the recesses being spaced along the length of the cylindrical valve chamber along the first axis;

said valve spool having means for preventing fluid drain from the first port of the winch motor when the operating valve is in the neutral position so that the control valve acts as a hydraulic brake;

the valve spool having means to urge the spool valve into the first spring chamber in response to the presence of pressurized fluid in the lower line when the operating valve is in the lower position and metering flow form the first port to the raise line to drain as a function of the pressure in the lower line to act as an over center valve;

said control valve further having means for connecting the brake release chamber to pressurized fluid when the operating valve is positioned in the raise and lower positions;

wherein elements of the winch motor must be continuously drained;

said control valve having means for selectively draining said elements through one of said spring chambers.

* * * * *